US006224415B1

(12) United States Patent
Gibboney, Jr.

(10) Patent No.: US 6,224,415 B1
(45) Date of Patent: May 1, 2001

(54) LOCKING LIGHT SOCKET AND LIGHT

(76) Inventor: James W Gibboney, Jr., 3910 Dial Mill Rd., Conyers, GA (US) 30208

( * ) Notice: Subject to any disclaimer, the term of this patent is extended or adjusted under 35 U.S.C. 154(b) by 0 days.

(21) Appl. No.: 09/502,911

(22) Filed: Feb. 11, 2000

(51) Int. Cl.[7] ..... H01R 13/627
(52) U.S. Cl. ..... 439/356; 439/923
(58) Field of Search ..... 439/356, 366, 439/280, 923, 306, 282

(56) References Cited

U.S. PATENT DOCUMENTS 1,724,592 * 8/1929 hudson ..... 439/356
4,573,754 * 3/1986 Hill ..... 439/280
4,601,528 * 7/1986 Spier ..... 439/282
5,137,465 * 8/1992 Chwang ..... 439/356
5,278,741 * 1/1994 Ehrman ..... 439/356
5,562,468 * 10/1996 Sakai et al. ..... 439/923

* cited by examiner

*Primary Examiner*—Neil Abrams
*Assistant Examiner*—Phuong KT Dinh
(74) *Attorney, Agent, or Firm*—Michael A Mann; Nexsen Pruet Jacobs & Pollard LLC

(57) ABSTRACT

An improved friction-fitted light and light socket where the base of the light has a resilient, beveled flange that deforms on insertion of the base into the light socket, thus resisting removal. To facilitate removal, the wall of the socket has a cutout portion dimensioned to receive a small tool, such as the end of the flathead screw driver, and thereby provide access to the base just below the flange so that the light can be pried free of the light socket.

10 Claims, 2 Drawing Sheets

LOCKING LIGHT SOCKET AND LIGHT

FIELD OF THE INVENTION

The present invention relates to lights and their corresponding light sockets. More particularly, the present invention relates to the way in which lights are secured within light sockets.

BACKGROUND OF THE INVENTION

In general, light bulbs have threaded bases that screw into threaded sockets. The threads hold the bulb in the socket. However, some lights are held in their sockets simply by friction. For example, Christmas light strings, which may include up to 200 lights, use friction fitted bulbs because it simplifies manufacture.

One problem with using friction to hold lights in light sockets of Christmas light strings is that if one of the lights comes out of the socket in a string where the bulbs are arranged electrically in series, the whole string will fail.

Thus, there remains a need for a way to secure friction-fitted lights in their light sockets more securely than is obtained with traditional friction fitting of lights. Moreover, if friction fitting can be done in such a way that the light will not readily be removable from its socket, such a way of securing lights in light sockets may replace the more traditional socket and lamp base threads.

SUMMARY OF THE INVENTION

According to its major aspects and briefly recited, the present invention is an improved light and its corresponding light socket. The light includes a bulb secured to a base which is formed to fit into the light socket. The base has a flange that deforms against the wall of the socket as the base is inserted into the socket. Furthermore, the flange, when deformed, locks against the inside surface of the socket wall in a way that it resists removal of the light in order to hold the light in the light socket more securely. To remove the light, a tool such as a screw driver is inserted into a key-way formed in the socket wall to allow the light to be pried from the socket.

An important feature of the present invention is the deformable flange. By deforming on insertion into the socket, the flange adds a spring force to the normal frictional force thereby increasing holding power.

Another important feature of the present invention is the cooperation between the deformable flange and the inside wall of the socket. The flange and wall are shaped so that the upper edge of the flange "digs" into the surface of the wall when the light is being pulled from the socket, thus resisting removal of the light from the socket.

Still another important feature of the present invention is the key-way in the socket that allows the light to be pried free easily with, for example, a flat heat screw driver.

Other features and their advantages will be apparent to those skilled in the art of lamp design from a careful reading of a Detailed Description Of Preferred Embodiments accompanied by the following drawings.

DETAILED DESCRIPTION OF PREFERRED EMBODIMENTS

Figure 1:
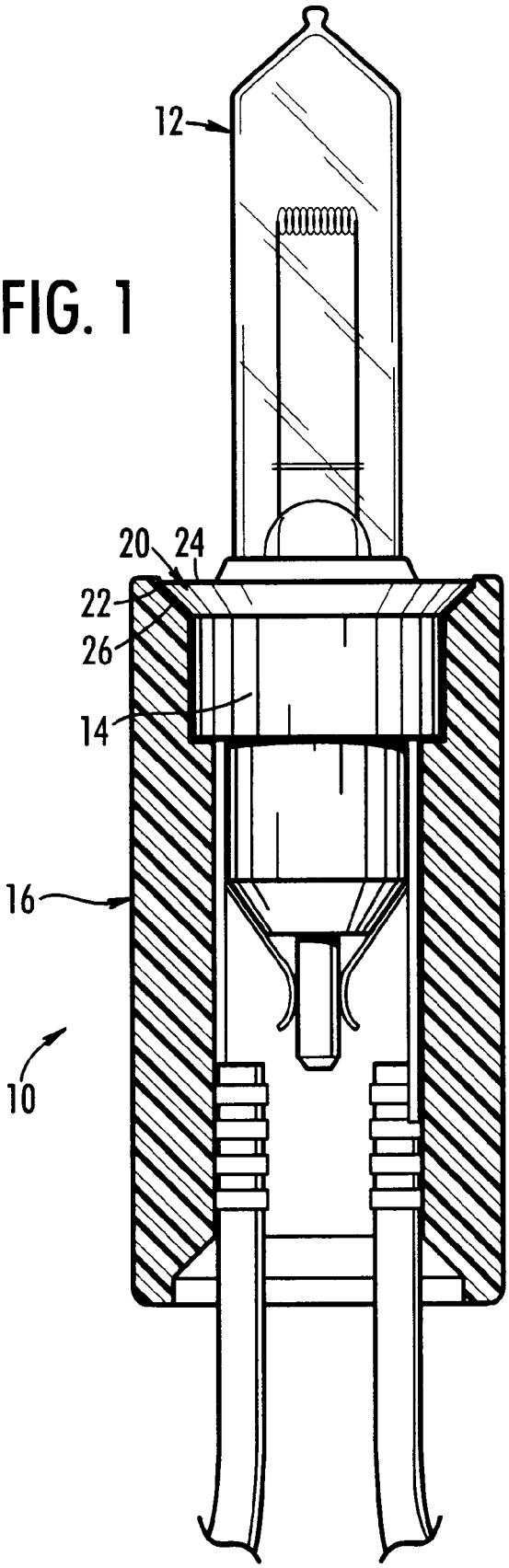
FIG. 1 is a cross-sectional view of a light socket with a light in it, according to a preferred embodiment of the present invention.
Figure 2A:
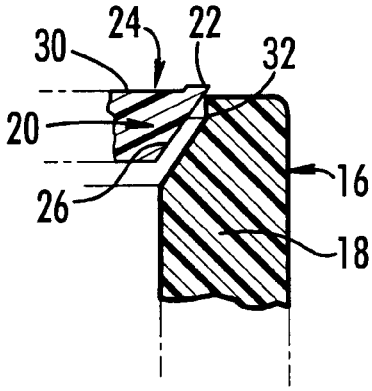
FIG. 2A and 2B are cross-sectional, detailed, side views of the base flange just outside and inserted into the light socket, respectively.
Figure 2B:
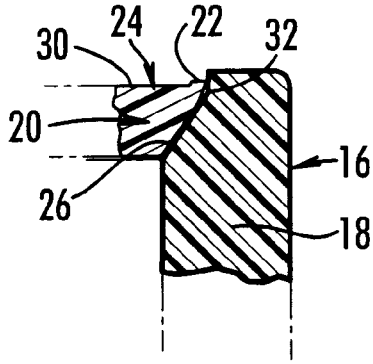
Figure 3:
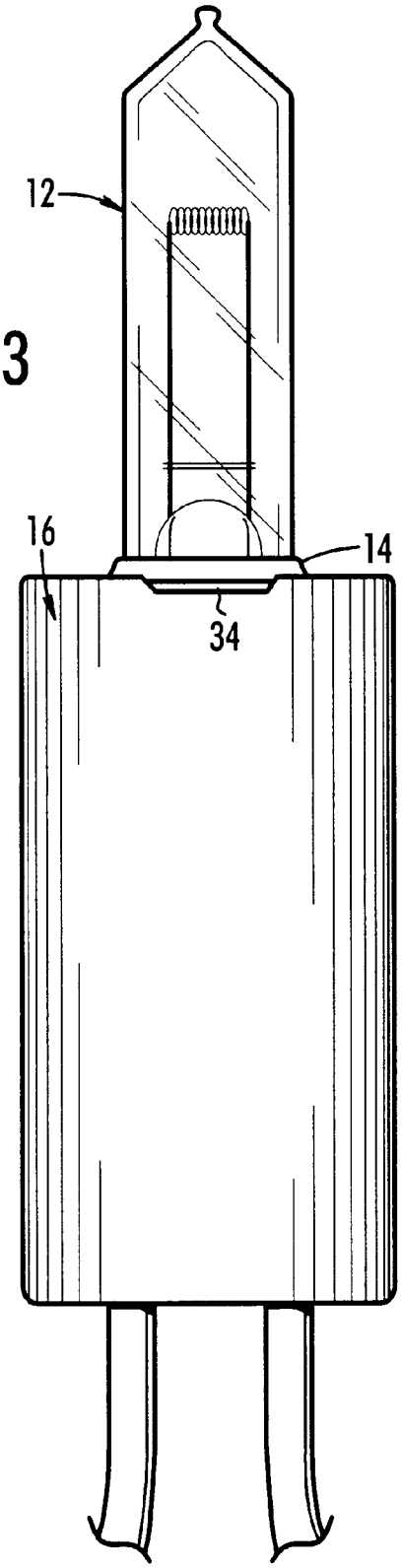
FIG. 3 is an external side view of a light and light socket showing the light removal key-way according to a preferred embodiment of the present invention.
Figure 4:
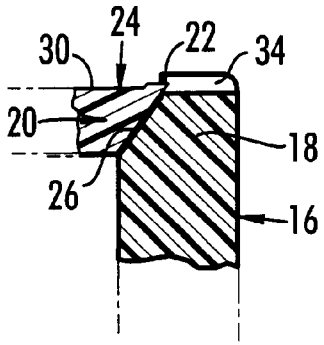
FIG. 4 is a cross sectional, detailed, side view showing the key-way, according to a preferred embodiment of the present invention.

The device of the invention comprises a light having a bulb received in and secured to a base that is friction fitted into a light socket. The corresponding light socket of the invention is dimensioned to receive this base. Additionally, a spring means carried by the device urges against removal of the base from the light socket.

Referring now to the figures, depicting a preferred embodiment of the present invention, there is illustrated a light 10 including a bulb 12 and a base 14, receivable in a light socket 16 having a wall 18. The spring means of the illustrated embodiment is a resilient flange 20, carried on base 14, that deforms when base 14 is received by light socket 16. Flange 20 in the illustrated preferred embodiment, is upwardly beveled with an upper edge 22 and an upper surface 24 and a lower, beveled surface 26. "Upwardly beveled" means that lower surface 26 is sloped toward upper surface 24 and upper surface 24 lies essentially in one plane. Upper surface 24 most preferably has an annular recess 30 formed inward of upper edge 22 of flange 20. Recess 30 allows flange 30 to deform more easily when the material of which flange 20 is made is relatively stiff. Preferably flange 20 is integral with base 14; that is, flange 20 is formed as a part of base 14. Flange 20 is slightly oversized; that is, it has a diameter measured at upper edge 22 that is slightly larger than the inner diameter of light socket 16 at the point where flange 20 meets light socket 16 when light 10 is fully seated in light socket 16. Of course, light socket 16 and base 14 need not be cylindrical in cross section but may have any other cross section such as square or rectangular. Most preferably, however, their shapes must generally correspond. In particular, wall 18 is widened to correspond to the shape of beveled, lower surface 26 of flange 20, except near outer edge 22 at location 32 where wall 18 does not correspond but causes the deformation of flange 20.

When base 14 is received by light socket 16, flange 20, because it is slightly oversized, is resiliently deformed by interference with wall 18 of light socket 16, thus providing the spring that locks base 14 into light socket 16. Flange 20 presses against wall 18 adding an increased frictional force. Moreover, outer edge 22 of the upwardly beveled flange 20 resists upward movement because it tends to "dig" into wall 18, not literally, but, because of its shape, it applies the greatest frictional force at outer edge 22 rather than along lower surface 26.

Those of ordinary skill will appreciate that other arrangements can achieve an equivalent effect. A flange may be carried by wall 18 for example, instead of base 14 and beveled downwardly.

The current preferred embodiment also includes means for facilitating the release of light 10 from light socket 16. To facilitate release of light 10, a recess, or cut out portion 34, in wall 18 of light socket 16 positioned to permit access to the area of base 14 just below outer edge 22 of flange 20. Cutout portion 34 is dimensioned to receive a tool such as the functional end of a small flathead screw driver which can be used to pry light 10 free of light socket 16 by slight rotation of the tool. When rotated, the tool forces outer edge 22 of flange 20 clear of wall 18 of light socket 16.

Other modifications and substitutions will be apparent to those skilled in the art of lamp manufacture from the foregoing description of preferred embodiments without departing from the spirit in scope of the present invention, defined by the appended claims.

What is claimed is:

1. A device, comprising:

a light having a bulb received in a base;

a light socket dimensioned to receive said base;

a flange for urging against removal of said base from said light socket said flange carried by said base and having an upper surface and an outer edge, said upper surface having an annular recess formed therein inward of said outer edge of said flange; and means for facilitating release of said base from said light socket.

2. The device as recited in claim 1, wherein said flange deforms when received by said light socket.

3. The device as recited in claim 1, wherein said flange is beveled.

4. The device as recited in claim 1, wherein said flange carried by said base is resilient.

5. The device as recited in claim 1, wherein said spring means includes a resilient, oversized flange carried by said base.

6. The device as recited in claim 1, wherein said spring means is a flange carried by said base, said flange having a lower surface, and wherein said facilitating means is a cutout portion in said light socket, said cutout portion permitting access to said base below said flange.

7. A device as recited in claim 5, wherein said facilitating means is a cutout portion of said light socket for permitting access to said base so that said base can be pried from said light socket.

8. A device as recited in claim 7, wherein said cutout portion is dimensioned to receive the end of a flat head screw driver.

9. A device as recited in claim 5, further comprising means for securing said light within said light socket.

10. A device, comprising:

a light having a bulb received in a base;

a light socket dimensioned to receive said base; and a flange carried by said base for urging against removal of said base from said light socket, said flange having an upper surface and an outer edge, said upper surface having an annular recess formed therein inward of said outer edge of said flange.

* * * * *